US005856823A

United States Patent [19]

Kimoto et al.

[11] Patent Number: 5,856,823

[45] Date of Patent: Jan. 5, 1999

[54] PLASMA DISPLAY

[75] Inventors: Takayuki Kimoto, Hirakata; Isao Kawahara, Osaka, both of Japan

[73] Assignee: Matsushita Electric Industrial Co., Ltd., Osaka, Japan

[21] Appl. No.: 528,019

[22] Filed: Sep. 14, 1995

[30] Foreign Application Priority Data

Oct. 28, 1994 [JP] Japan ..... 6-265330

[51] Int. Cl.[6] ..... G09G 5/00

[52] U.S. Cl. ..... 45/153; 345/155

[58] Field of Search ..... 345/60, 72, 150, 345/152, 153, 155, 88, 199; 315/169.4, 169.1

[56] References Cited

U.S. PATENT DOCUMENTS

| | | | |
|---|---|---|---|
| 5,170,152 | 12/1992 | Taylor | 345/155 |
| 5,341,153 | 8/1994 | Benzshawel et al. | 345/152 |
| 5,469,190 | 11/1995 | Masterson | 345/155 |
| 5,479,189 | 12/1995 | Chesavage et al. | 345/150 |

FOREIGN PATENT DOCUMENTS

| | | |
|---|---|---|
| 0 525 750 A2 | 2/1993 | European Pat. Off. . |
| 4-195087 | 7/1992 | Japan . |
| 1 494 509 | 12/1977 | United Kingdom . |

*Primary Examiner*—Richard A. Hjerpe
*Assistant Examiner*—Tracy H. Nguyen
*Attorney, Agent, or Firm*—Ratner & Prestia

[57] ABSTRACT

A plasma display having a quartet type pixel structure provides a high grade and excellent picture quality picture and maintains good white balance and excellent intensity levels. The plasma display comprises a reference circuit ϕ for outputting a control signal based on the least significant bit of a digitized green video signal and a timing signal and an arithmetic circuit 8 for performing an arithmetic operation on the output of the reference circuit. As a result of this arrangement, the least significant bit information, that was lost by halving the green signal value to maintain the white balance is incorporated in the halved green signal based on a timing signal, thereby realizing 256 intensity levels without degrading the halftone in the video picture.

5 Claims, 7 Drawing Sheets

PLASMA DISPLAY

BACKGROUND OF THE INVENTION

The present invention relates to a plasma display for use in thin TVs, personal computers, workstations and the like, and the plasma display operation.

In recent years, color plasma displays (PDP) provided with a memory function have been in demand for the purpose of making thin displays that can replace color CRTs that are widely used in television receivers. There are two kinds of plasma displays provided with a memory function, i.e. an AC type and a DC type. The DC type PDP, which is considered more practical, is explained below with reference to FIGS. 2 and 3.

As illustrated in FIG. 2, a DC type plasma display has two kinds of display matrix groups, i.e. a scan electrode group 4 consisting of cathodes K1, K2, K3, etc. and a display electrode group 5 consisting of anodes A1, A2, A3, etc. with each respective crossing point thereof forming a display discharge cell 3. A space between display electrode group 5 and scan electrode group 4 is filled with a discharge gas such as helium-xenon or the like. The discharge cell, 3 formed where a display electrode and a scan electrode cross each other, emits discharge light upon application of a voltage according to display information. The light emitted by the numerous discharge cells 3 results visual information which is recognizable by a viewer. For color displays, a quartet structure formed of two green pixels, one blue pixel and one red pixel is used and fluorescent substances corresponding to the above colors are disposed on each respective discharge cell 3.

Next, producing the intensities of the pixels in the picture display will be explained.

FIG. 3 is a time chart illustrating how the intensities are produced. One field corresponding to a picture is divided into a plurality of sub-fields, and the intensities are produced by controlling the light emission period of each respective sub-field. In this particular case, the number of intensity levels is $2^8$=256. One field is divided into 8 sub-fields, each having an equal time period, and the light emission period of each respective sub-field is assigned a different value. Pixels on each respective scan line can be displayed in any of the 256 intensity levels by selecting the light emission period at the corresponding sub-fields.

Accordingly, color image display is made possible with a plasma display by forming discharge cells 3 at the crossing points between display electrodes and scan electrodes. Phosphors of green, blue and red are disposed in a quartet structure and illuminated to create a color display. Varying the intensity of the display is made possible by means of the sub-fields.

The arrangement of two green pixels disposed in the quartet structure enhances brightness and also improves the apparent display resolution. Since there are two green pixels in the quartet structure, simply supplying video signals to respective pixels of red, green and blue would disturb the white balance and reproduce excessive green color. On the other hand, supplying the green video signal with its amplitude reduced by ½ in order to preserve the white balance would cause the intensity to deteriorate to 128 levels due to a reduction in the signal amplitude.

SUMMARY OF THE INVENTION

The object of the present invention is to provide a plasma display of high grade and good picture quality by paying a particular attention to the fact that there are two green pixels employed in the quartet type RGB dot-matrix structure, and by having the brightness enhanced and the apparent display resolution improved while maintaining a good white balance as well as a wide range of intensities.

The present invention is a plasma display, which is characterized by having two green pixels, one blue pixel and one red pixel as one unit, comprising:

- a reference circuit for outputting as a control signal a logical product between the least significant bit of a digitized green video signal and a signal obtained by dividing by two the sampling clock signal employed in digitization;
- an arithmetic circuit for adding or subtracting the control signal output by said reference circuit to the digitized green video signals; and
- a driving circuit for inputting digitized red and blue signals together with the output from said arithmetic circuit.

The foregoing circuits make it possible to incorporate the least significant bit information, which was lost by halving the green signal value to maintain the white balance, in the halved green signal based on a timing signal, thereby realizing 256 intensity levels without degrading the halftone in the video pictures.

Further, where the control signal is a logical product between the least significant bit of the digitized green video signal and a signal obtained by dividing by two the sampling clock signal employed in digitization, 256 levels can be realized without causing any deterioration in intensity while maintaining the average brightness within one line.

In a second embodiment, the reference circuit generates a logical product between, an exclusive OR of a signal obtained by dividing by two the sampling clock signal employed in digitization and a signal obtained by dividing by two the horizontal synchronizing signal, and the least significant bit value of the digitized green video signals The logical product is output as a control signal.

According to the foregoing circuitry, when arithmetic adding takes place in one of the two green pixels of a quartet structure, another arithmetic adding is performed in a green pixel any of the neighboring quartet structures. This controls the green brightness and at the same time maintains the white balance as well as the while maintaining the average horizontal and vertical brightness. The result is a video image of high grade and excellent picture quality.

DETAILED DESCRIPTION OF THE INVENTION

Figure 1:
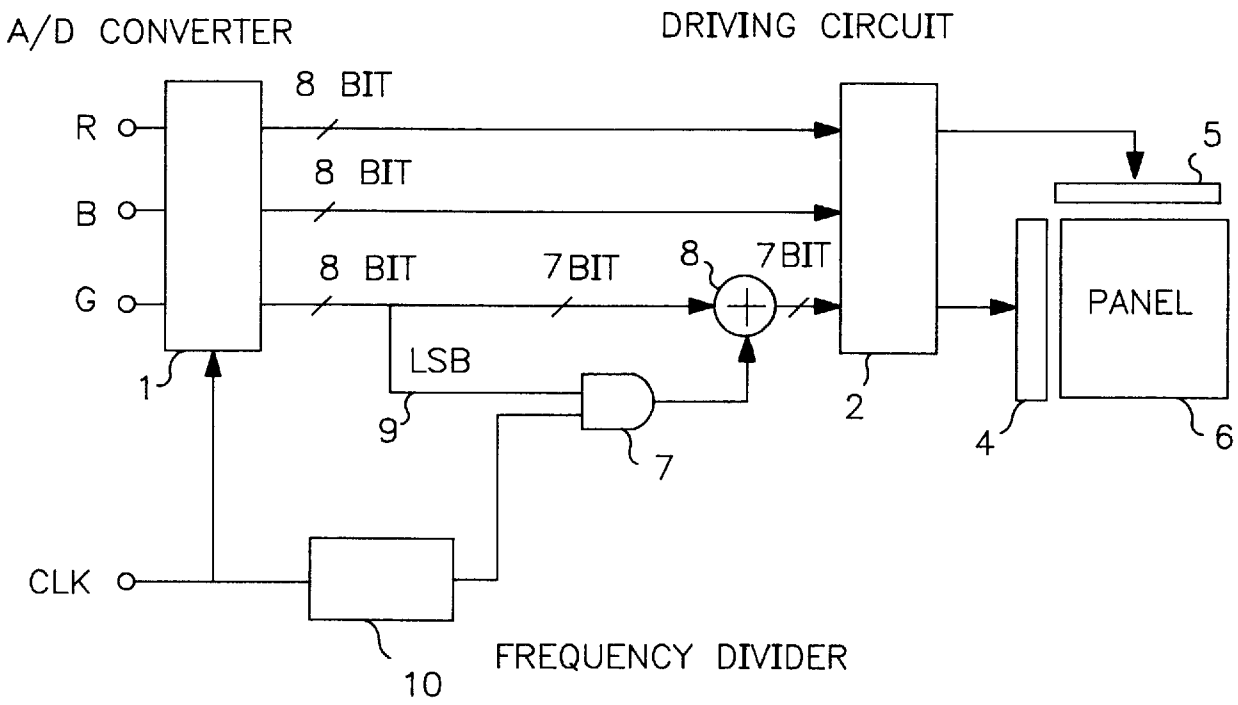
FIG. 1 is a block diagram of a plasma display in a first embodiment of the present invention.
Figure 2:
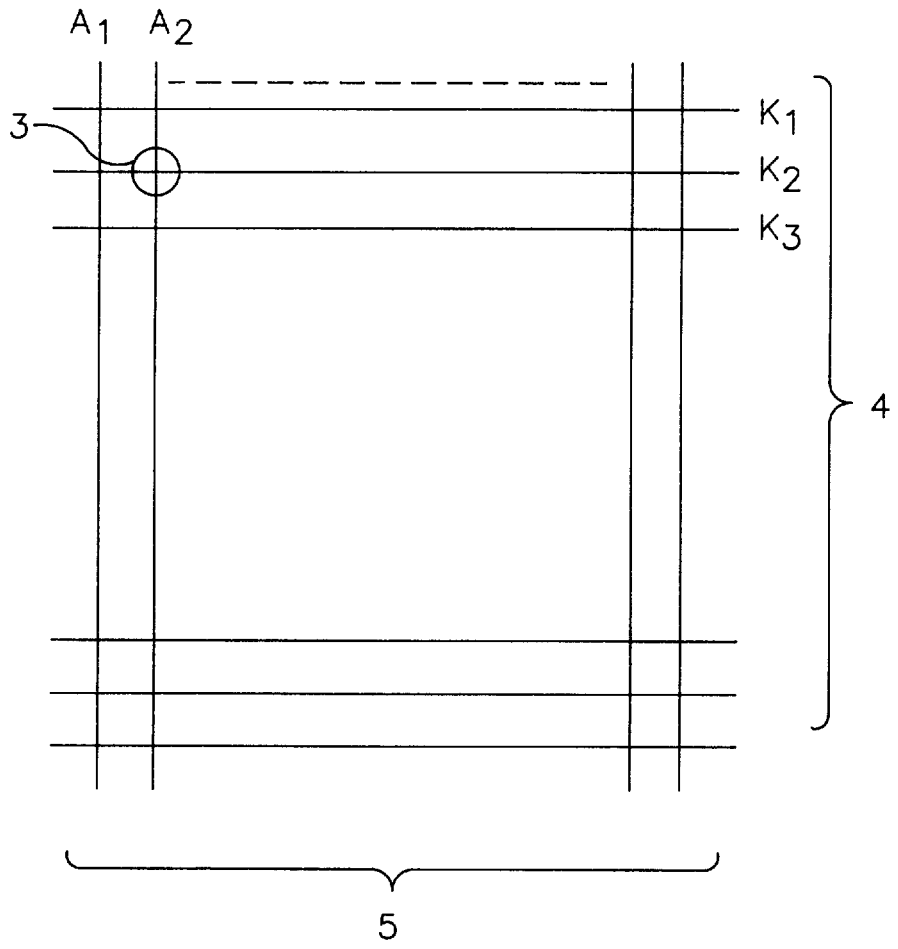
FIG. 2 (PRIOR ART)
FIG. 2 is a plan view of the electrode arrangements on the plasma display panel.

A plasma display and the plasma display operation will be explained with reference to specific exemplary embodiments thereof.

The same reference numerals will be used throughout all the Figures to refer to elements having the same functions.

Example 1

FIG. 1 is a block diagram of a plasma display panel whereby video signals decoded into R, G and B, are reproduced on the display panel.

To begin with, each respective video signal of an NTSC RGB signal is converted to an 8 bit digital signal by A/D converter 1.

A reference circuit 7 outputs as a control signal a logical product between the least significant bit (LSB) 9 of a digitized green video signal and a signal output by frequency divider 10 obtained by dividing by two the sampling clock signal used by A/D 1. Arithmetic circuit 8 adds or subtracts the control signal output by the reference circuit 7 to the digitized green video signal. A driving circuit 2 inputs digitized red and blue signals together with the output from the arithmetic circuit 8.

Figure 3:
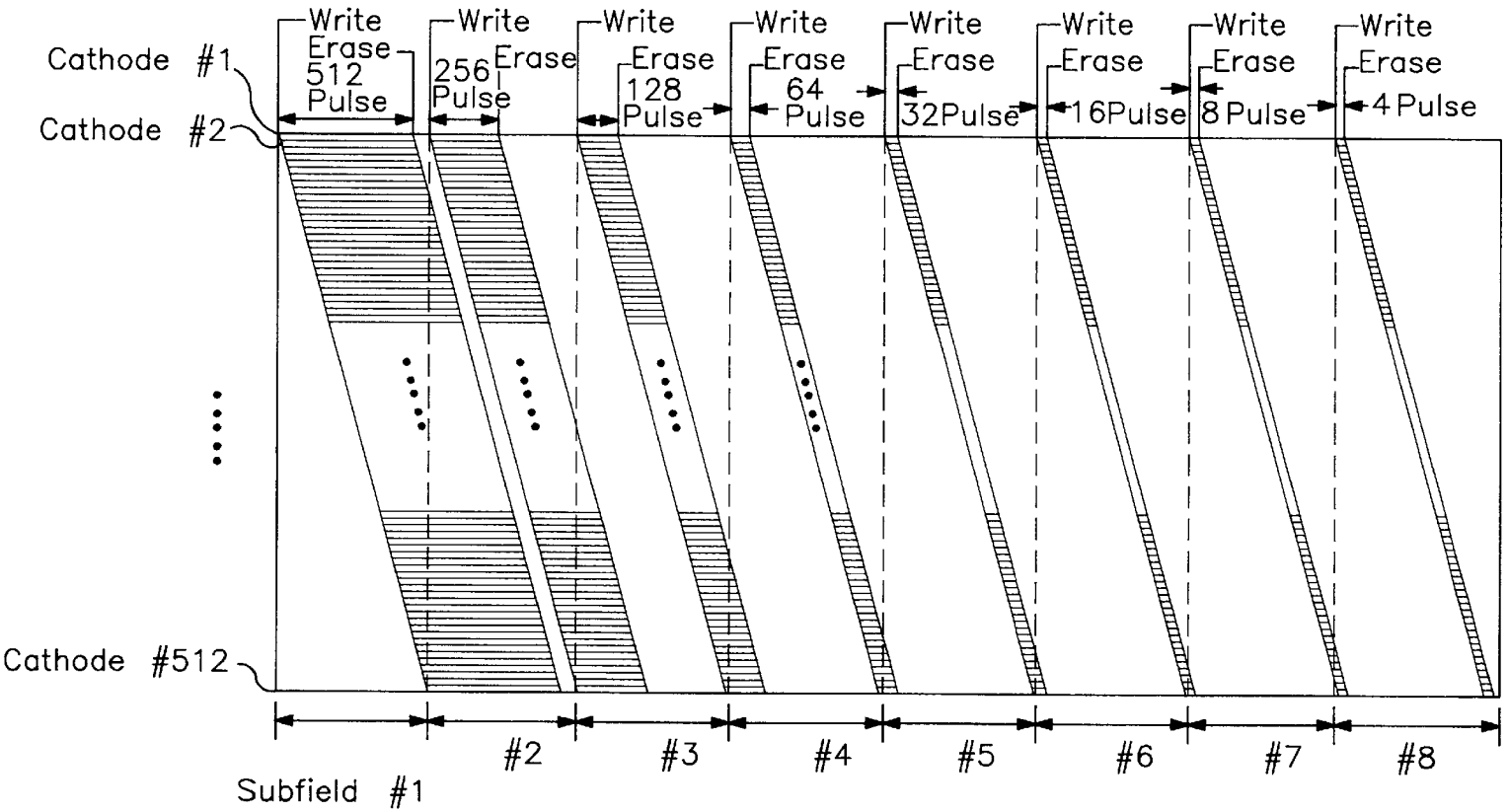
FIG. 3 (PRIOR ART)
FIG. 3 is a time chart for the plasma display sub-fields.

Then, the 8 bit signals inputted to the driving circuit 2 are fed to scan electrodes 4 and display electrodes 5. Driving circuit 2 performs combinational operations based on the number of pulse times corresponding to the gray levels of 128, 64, 32, 16, 8, 4, 2 and 1 as defined in the time chart for the 8 sub-fields shown in FIG. 3.

Signals of a driving waveform that are necessary for each respective discharge cell 3 of a display panel 6 to emit light are applied to the scan electrodes 4 and the display electrodes 5. Thus, video images are displayed on display panel 6.

More specifically, when level 127 out of the 256 intensity levels is applied to the plasma display, red (R) and blue (B) pixels within a quartet respectively present intensities corresponding to the pulse number for level 127.

However, since there are two green pixels in one quartet, there will be too much green if both green pixels present intensities corresponding to the pulse number for level 127.

To solve this problem, the input signal digitized by the A/D converter 1 is converted to a 7 bit signal corresponding to level 63. A logical product between the least significant bit value and the signal obtained by dividing by two the sampling clock that is used in digitization by the A/D converter 1 is taken. The control signal is a 1 when the logical product is true and a 0 when the logical product is false. Accordingly, one of the two green pixels within a quartet is adjusted to level 64 by adding one level through arithmetic circuit 8. The other green pixel remains at level 63. As a result, an average brightness level of 63.5 is realized, and the sum of the brightness levels of the two green pixels within one quartet becomes level 127 exactly.

When the least significant bit happens to be 1 (for example, when the video signal has a level of 127), the logical product value output by reference circuit 7 becomes true or false in response to a signal obtained through dividing by two the sampling clock used in the A/D converter. Therefore, in each quartet shown in FIG. 5, the logical products corresponding to the green pixels at the lower right and upper left are different from one another. Thus, the total intensity of the green pixels for each respective quartet is at the correct level 127.

Figure 6:
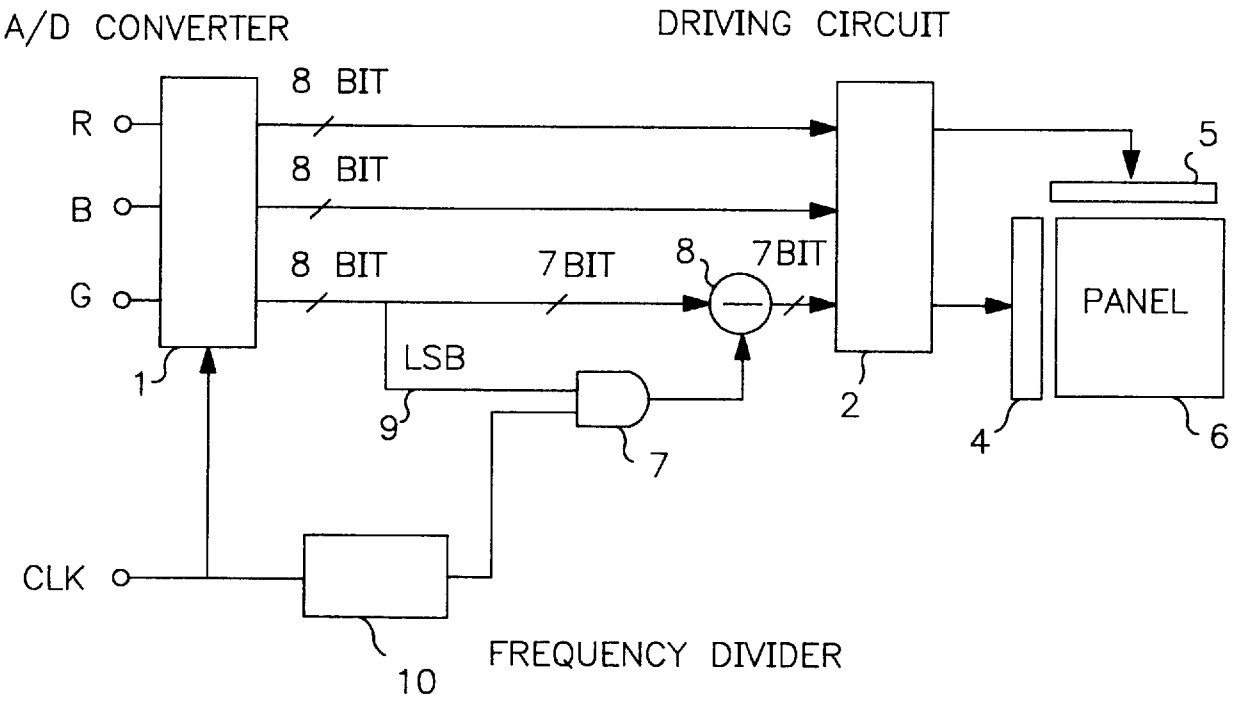
FIG. 6 is a block diagram of a plasma display in a third embodiment of the present invention.
Figure 7:
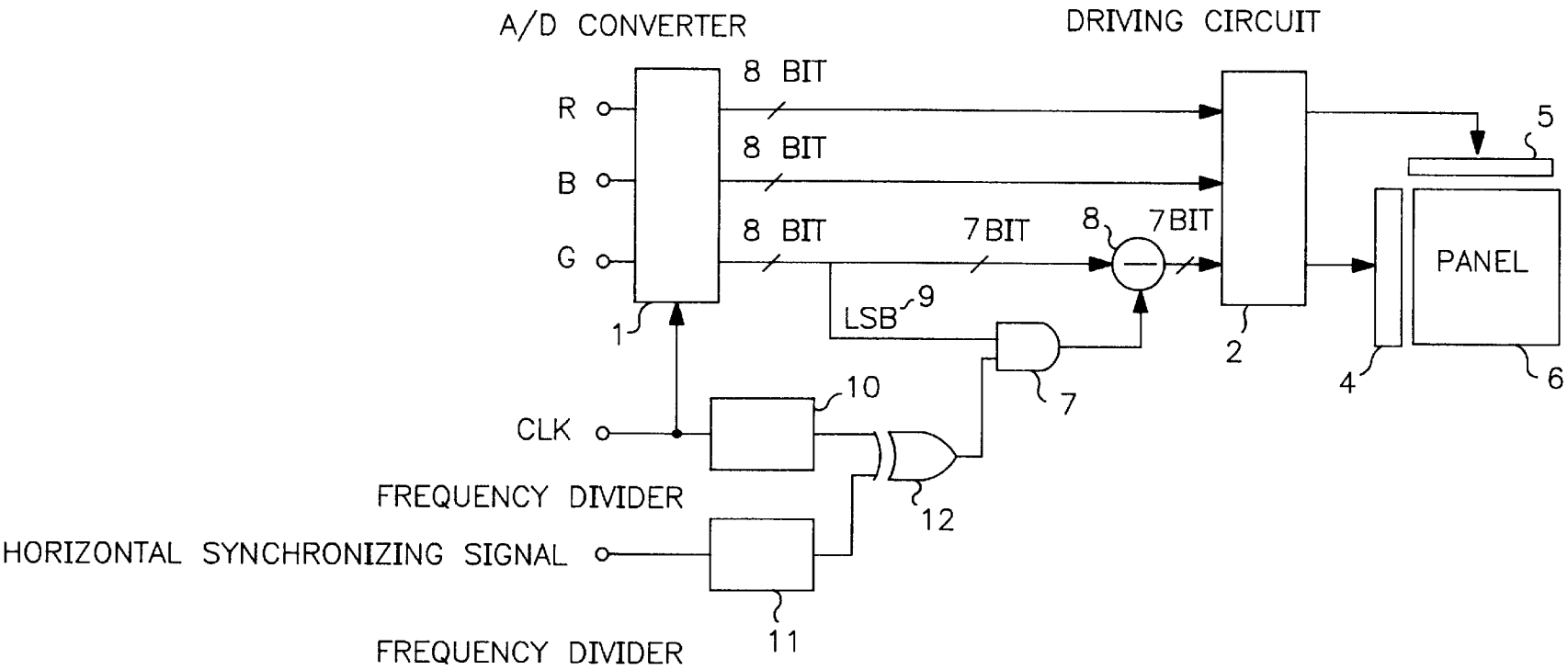
FIG. 7 is a block diagram of a plasma display in a fourth embodiment of the present invention.

As shown in FIGS. 6 and 7, setting the intensity of a signal to level 64, and then subtracting 1 from level 64 can equally realize level 127. In the embodiments shown in FIGS. 6 and 7, the arithmetic circuit 8 performs subtraction.

In the case where level 128 is presented, the least significant bit is 0 and thus reference circuit 7 outputs 0. The green pixel intensities are produced according to the pulse number that corresponds to level 64 without adding or subtracting 1 from either green pixel.

In contrast to the prior art case wherein 8 bit signals have been used as they are for display, the present invention makes it possible to have the least significant bit information, which is lost by halving the green signal magnitude to maintain the white balance, reflected in the halved green signal by using a signal obtained by dividing by two the sampling clock used by A/D converter 1, thereby realizing intensities extending over 256 gray levels.

Example 2

Figure 4:
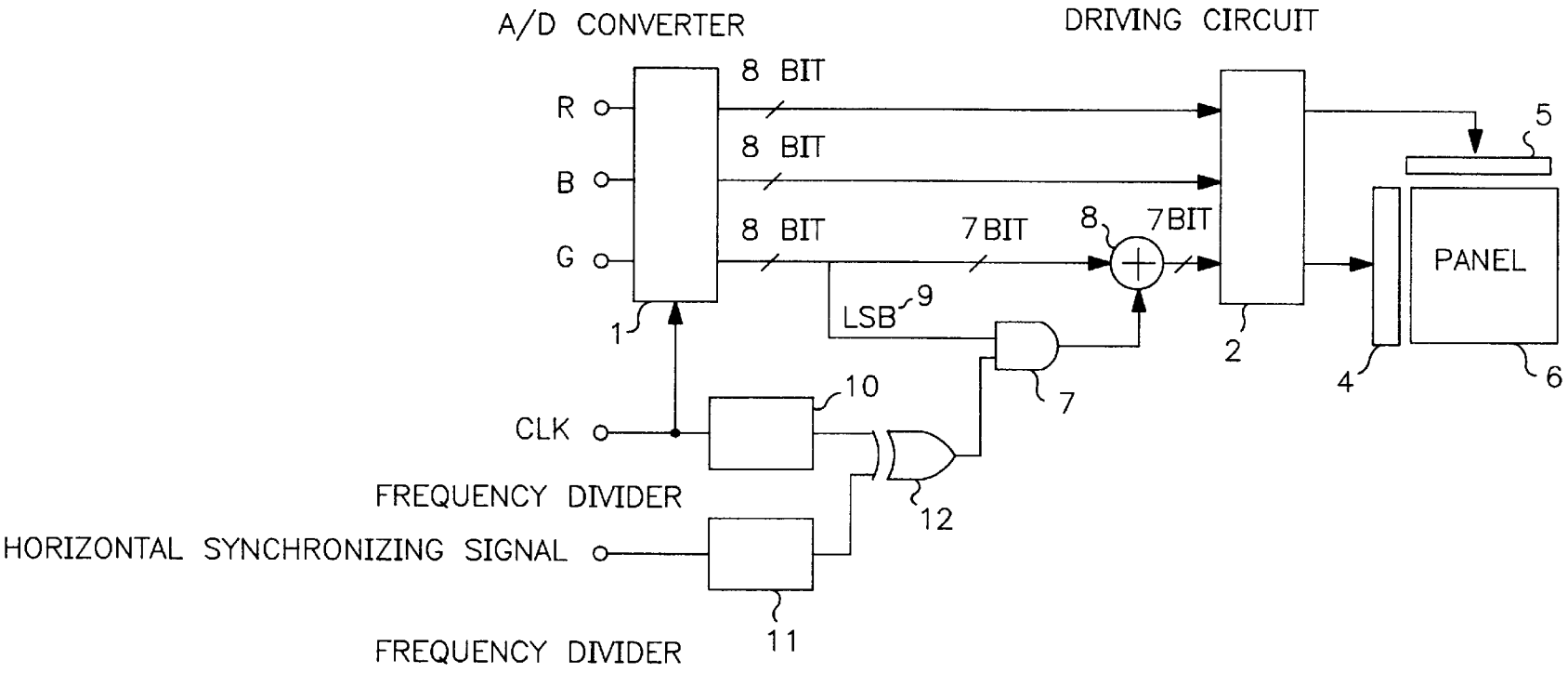
FIG. 4 is a block diagram of a plasma display in a second embodiment of the present invention.

FIG. 4 is a block diagram of a plasma display panel according to a second embodiment of the present invention whereby video signals decoded into R, G and B are reproduced on the plasma display panel.

More specifically, each NTSC red, green and blue signal is converted to a digital signal by an A/D converter 1 and fed into a driving circuit 2. Then, the signals are applied to scan electrodes 4 and display electrodes 5 to produce waveforms that are required for the display panel 6 to emit light, thereby displaying video pictures. This is the same as Example 1.

An exclusive OR gate 12 inputs a signal output by frequency divider obtained by dividing by two the sampling clock signal used by A/D converter 1 and a signal output by frequency divider 11 obtained by dividing by two the horizontal synchronizing signal. The output of exclusive OR gate 12 is a control signal that controls an add operation performed by arithmetic circuit 8.

More specifically, a logical product between the least significant bit of the digitized green video signal and the exclusive OR gate 12 is obtained to produce a control signal, which is then added to the bit digitized green signal by arithmetic circuit 8.

Figure 5:
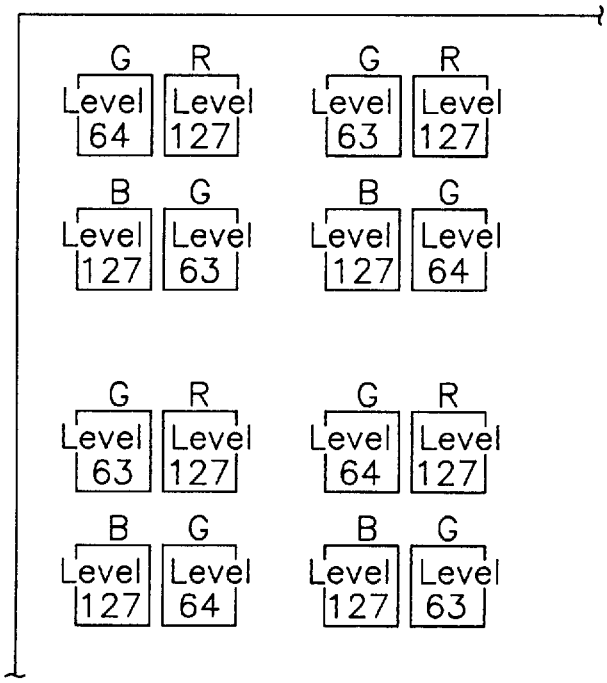
FIG. 5 is a plan view of a panel illustrating intensities of individual pixels in the display.

As a result, the upper green pixel has level 64 and the lower green pixel has level 63 in the first quartet. The upper green pixel has level 63 and the lower green pixel has level 64 in the second quartet, as shown in FIG. 5.

In the line direction, the odd number lines and even number lines alternatively have 1 added to the green pixel level according to the condition of the horizontal synchronizing signal.

Thus, the sum of the brightness levels of two green pixels within one quartet is level 127.

Therefore, the average brightness in the horizontal and vertical directions is uniform, the white balance is maintained, and intensities extending over 256 gray levels are all achieved at the same time.

Thus, the plasma display of the present invention comprises a reference circuit 7 that outputs a control signal based on a value of the least significant bit 9 of a digitized green video signal and a timing signal. An arithmetic circuit 8 performs an arithmetic operation on the digitized green video signal and the output from the reference circuit 7. The least significant bit information, which was lost by halving the green signal value in order to take a white balance, is incorporated in the halved green signal based on a timing signal, thereby realizing 256 intensity levels without degrading the halftone in the video picture.

The control signal is a logical product between the least significant bit of the digitized green video signal and a signal obtained by dividing by two the sampling clock used in A/D converter 1, thereby realizing 256 intensity levels without causing any degradation in the halftone in the video picture while maintaining the average brightness within one line.

In the plasma display of the second embodiment of the present invention, the control signal is a logical product between an exclusive OR of a signal obtained by dividing by two the sampling clock used by A/D converter 1 and a signal obtained by dividing by two the horizontal synchronizing signal, and the least significant bit of the digitized green video signal This results in video images of high grade and excellent picture quality while maintaining uniform average horizontal and vertical brightness and also achieving both good white balance and intensity at the same time.

The plasma displays of Examples 1 and 2 are easy to manufacture and cost effective, and will make valuable contributions to the industry.

What is claimed:

1. A plasma display including a plurality of pixel units, each pixel unit including two green pixels, one blue pixel and one red pixel, the plasma display comprising:

a reference circuit for outputting a control signal based on the least significant bit of a digitized green video signal and a timing signal;

an arithmetic circuit for performing an arithmetic operation on said digitized green video signal and control signal; and a driving circuit for receiving digitized red and blue signals together with the output from said arithmetic circuit.

2. The plasma display according to claim 1, wherein the control signal from the reference circuit is a logical product between the least significant bit of the digitized green video signal and a signal obtained by dividing by two a sampling clock used to digitize the red, blue, and green signals.

3. The plasma display according to claim 1, wherein the control signal from the reference circuit is a logical product between, (a) an exclusive OR of a signal obtained by dividing by two a sampling clock used to digitize the red, blue and green signals and a signal obtained by dividing by two a horizontal synchronizing signal, and (b) the least significant bit of the digitized green video signal.

4. The plasma display according to claim 1, wherein the arithmetic circuit is an addition circuit for adding 1 to the digitized video signal of one of the two green pixels selected according to the least significant bit of the digitized green signal.

5. The plasma display according to claim 1, wherein the arithmetic circuit is a subtraction circuit for subtracting 1 from the digitized video signal of one of the two green pixels selected according to the least significant bit of the digitized green signal.

* * * * *